US010373792B2

(12) United States Patent
Price et al.

(10) Patent No.: US 10,373,792 B2
(45) Date of Patent: Aug. 6, 2019

(54) CATHODE ASSEMBLY FOR USE IN X-RAY GENERATION

(71) Applicant: General Electric Company, Schenectady, NY (US)

(72) Inventors: John Scott Price, Niskayuna, NY (US); Xi Zhang, Ballston Lake, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 296 days.

(21) Appl. No.: 15/195,654

(22) Filed: Jun. 28, 2016

(65) Prior Publication Data

US 2017/0372863 A1 Dec. 28, 2017

(51) Int. Cl.
*H01J 1/15* (2006.01)
*H01J 35/06* (2006.01)
*H01J 35/14* (2006.01)

(52) U.S. Cl.
CPC ..... *H01J 35/14* (2013.01); *H01J 1/15* (2013.01); *H01J 35/06* (2013.01)

(58) Field of Classification Search
CPC ..... H01J 2235/068; H01J 35/06; H01J 3/027; H01J 3/12; H01J 9/042; H01J 1/16; H01J 35/02; H01J 35/14; H01J 1/15
See application file for complete search history.

(56) References Cited

U.S. PATENT DOCUMENTS 2,160,605 A * 5/1939 Suits ..... H05G 1/52 378/107
2,215,426 A * 9/1940 Machlett ..... H01J 35/06 313/287
4,065,689 A * 12/1977 Pleil ..... H01J 35/14 378/125
4,217,517 A 8/1980 Delair et al.
6,464,551 B1 10/2002 Lipkin et al.
8,054,944 B2 11/2011 Freudenberger et al.
8,374,315 B2 2/2013 Freudenberger
8,831,178 B2 9/2014 Lemaitre
2010/0079053 A1* 4/2010 Andrews ..... H01J 3/027 313/326
2011/0255667 A1* 10/2011 Lemaitre ..... H01J 35/06 378/113
2012/0082300 A1 4/2012 Onken
(Continued)

FOREIGN PATENT DOCUMENTS

DE 19504305 A1 8/1996
DE 295 21 696 U1 3/1998
(Continued)

OTHER PUBLICATIONS

Machine translation of JP 2014-229388 A published in 2014.*
(Continued)

*Primary Examiner* — Chih-Cheng Kao
(74) *Attorney, Agent, or Firm* — Fletcher Yoder, P.C.

(57) ABSTRACT

A cathode assembly design is provided that includes two flat emitters, a longer emitter filament and a shorter emitter filament. In one implementation the focal spot sizes produced by the long and short emitters overlap over a range. Thus, one emitter filament may be suitable for generating small and concentrated focal spot sizes while the other emitter filament is suitable for generating small and large focal spots sizes.

15 Claims, 9 Drawing Sheets

(56) References Cited

U.S. PATENT DOCUMENTS

| | | | | |
|---|---|---|---|---|
| 2012/0321048 | A1 | 12/2012 | Hubbard | |
| 2015/0117617 | A1* | 4/2015 | Ishihara | H01J 35/06 378/138 |
| 2016/0015351 | A1* | 1/2016 | Konno | A61B 6/032 378/4 |
| 2017/0092456 | A1 | 3/2017 | Zhang et al. | |

FOREIGN PATENT DOCUMENTS

| | | | |
|---|---|---|---|
| EP | 2018650 | B1 | 9/2011 |
| EP | 1715503 | B1 | 1/2014 |
| EP | 2 869 327 | A1 | 5/2015 |
| JP | 2014-229388 | A | 12/2014 |

OTHER PUBLICATIONS

Lee, Tae Dong, et al.; "Electron optics simulations of CNT-based x-ray source operating at low gate voltage", Vacuum Nano, electronics Conference (IVNC), 2012 25th International, pp. 1-2, Jul. 9-13, 2012, Jeju.

Xu, Yiming, et al.; "Design of a 3D field emission electron source with improved emission current density and cathode life", Proc. SPIE 8668, Medical Imaging 2013: Physics of Medical Imaging, 866808, vol. 8668, Mar. 6, 2013, Florida, USA.

International Search Report and Written Opinion issued in connection with corresponding PCT Application PCT/US2017/39459, dated Oct. 2, 2017.

* cited by examiner

CATHODE ASSEMBLY FOR USE IN X-RAY GENERATION

BACKGROUND

The subject matter disclosed herein relates to X-ray tubes, and in particular, to X-ray cathode systems for use in X-ray generation.

Various types of medical imaging systems and treatment systems (e.g., radiation therapy systems) generate X-rays as part of their operation. For example, with respect to imaging techniques, those based on the differential transmission of X-rays include, but are not limited to, fluoroscopy, mammography, computed tomography (CT), C-arm angiography, tomosynthesis, conventional X-ray radiography, and so forth. X-ray generation in such contexts is generally performed using an X-ray tube. X-ray tubes typically include an electron emitter, such as a cathode, that releases electrons at high acceleration. Some of the released electrons impact a target anode. The collision of the electrons with the target anode produces X-rays, which may be used in a suitable imaging or treatment device.

In thermionic cathode systems, a filament is present that releases electrons through the thermionic effect, i.e. in response to being heated. One challenge in such systems is providing long electron emitter life along with high beam current. In particular, high beam current is generated by heating an emitter to high temperatures—approaching 2600 C. At these temperatures the emitter material, typically metal (e.g., tungsten), evaporates. The rate of evaporation increases as the temperature increases. Thus, the useful life of an electron emitter of an X-ray tube may be limited, particularly in high beam current usage.

BRIEF DESCRIPTION

In one embodiment, a cathode assembly is provided. In accordance with this embodiment, the cathode assembly includes: at least two flat filaments each comprising an electron emissive surface when heated, wherein a first flat filament has an electron emissive area that is less than an electron emissive area of a second flat filament; a set of width bias electrodes positioned along a first dimension of the flat filaments, wherein the set of width bias electrodes controls the width of a focal spot generated by the flat filaments during operation; and a set of length bias electrodes positioned along a second dimension of the flat filaments, wherein the set of length bias electrodes controls the length of the focal spot during operation.

In a further embodiment, an X-ray tube is provided. In accordance with this embodiment, the X-ray tube includes: an anode; and a cathode. The cathode includes: a pair of flat filaments that emit electrons when heated, wherein a first flat filament is longer than a second flat filament of the pair of flat filaments; a pair of width bias electrodes positioned on opposite sides of the pair of flat filaments along a first dimension; and a pair of length bias electrodes positioned on opposite sides of the pair of flat filaments along a second dimension perpendicular to the first dimension.

In an additional embodiment, a method for generating an electron beam focal spot on a target is provided. In accordance with this method, an input is received specifying a size of the electron beam focal spot on the target. Based on the input, a first emitter filament and a second emitter filament of a cathode assembly are selected between. If the input specifies a first focal spot size, the first emitter filament is selected; if the input specifies a second focal spot size, either the first emitter filament or the second emitter filament is selected; and if the input specified a third focal spot size, the second emitter filament is selected. The selected emitter filament is operated to generate an electron beam focal spot of the size specified by the input on the target.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
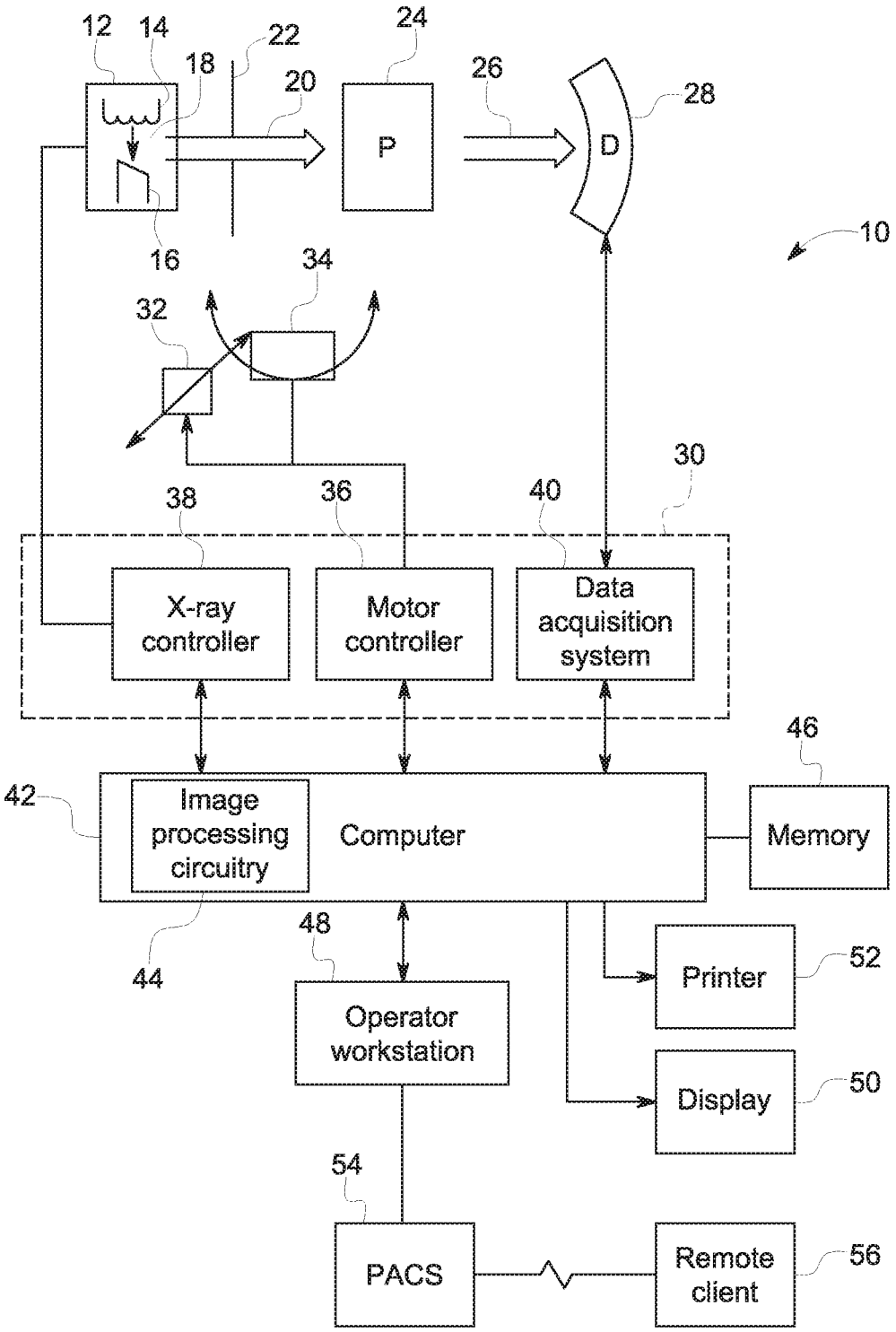
FIG. 1 is a diagrammatical illustration of an exemplary CT imaging system, in accordance with an embodiment of the present disclosure.

One or more specific implementations will be described below. In an effort to provide a concise description of these implementations, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

As discussed herein, in the context of electron emitters (i.e., cathode assemblies) used in the generation of X-rays, thermionic filaments are disclosed that may be employed to emit a stream of electrodes. The thermionic filaments may be induced to release electrons from the filament's surface through the application of heat energy. Indeed, the hotter the filament material, the greater the number of electron that may be emitted. The filament material is typically chosen for its ability to generate electrons through the thermionic effect and for its ability withstand high heat, in some cases, upwards of approximately 2500° C. or higher. An example of a suitable filament material is tungsten or a tungsten derivative, such as doped tungsten (i.e., tungsten with added impurities) or a coated tungsten substrate.

In accordance with presently described embodiment, interventional X-ray tubes use cathodes with two different electron emitter (i.e., filament) lengths, where each emitter is typically a flat emitter or coiled tungsten wire). High power large focal spot (e.g., 1.0 IEC) exposures (i.e., Record mode exposures) are made using the longer emitter. Fluroscopic mode exposures, using small spot dimensions (e.g., 0.6 IEC) are made using the shorter emitter filament. Focal spot sizes are primarily controlled via length and width bias electrodes. Electrodes may also be provided for 'gridding' which can shut off the beam altogether by applying a large negative (−) potential.

Thus, in accordance with the present approach an asymmetric flat emitter cathode design is provided that includes two flat emitters, a longer emitter filament and a shorter emitter filament, with gridding and voltage-controlled focal spot size control. In one implementation the focal spot sizes produced by the long and short emitters overlap over a range 0.5 IEC to 0.6 IEC. Thus, one emitter filament (the shorter filament) is suitable for generating small (e.g., 0.6 IEC) and concentrated (e.g. (0.3 IEC) focal spot sizes while the longer emitter filament is suitable for generating small (e.g., 0.6 IEC) and large focal spots (e.g., 1.0 IEC). As used herein, IEC refers to the focal spot size standards promulgated by the International Electrotechnical Commission. Under these standards, (denoted by the IEC acronym herein, a nominal focal spot value (f) of 0.3 (e.g., concentrated) corresponds to focal spot dimensions of 0.3 mm-0.45 mm width and 0.45 mm-0.65 mm length; a nominal focal spot value of 0.6 (e.g., small) corresponds to focal spot dimensions of 0.6 mm-0.9 mm width and 0.9 mm-1.3 mm length; and a nominal focal spot value of 1.0 (e.g., large) corresponds to focal spot dimensions of 1.0 mm-1.4 mm width and 1.4 mm-2.0 mm length.

This focal spot size redundancy allows the imaging system to use either the short or long emitter for small focal spot procedures (e.g., fluoroscopic exams). Thus, in operation the system may switch between emitter filaments to spread or balance wear (e.g., operating time) between emitter filaments or, in the event of failure of one of the emitter filaments (e.g., an open filament error) to switch to the remaining operable filament. Under normal operating conditions the redundancy allows for extended life of the emitters.

With the preceding in mind, it may be useful to discuss generalized embodiments of imaging systems that may incorporate an asymmetric cathode as described herein before discussing such asymmetric cathodes in detail. Turning now to the figures, FIG. 1 illustrates an X-ray-based imaging system 10 for acquiring and processing image data. In the illustrated embodiment, system 10 includes rotational and translational aspects for imaging the patient (or imaged object) at different angles and positions (such as a C-arm, computed tomography, or tomosynthesis type system) though it should be understood that such components may not be present in the each type of imaging system in which the asymmetric cathode may be employed. In general, the imaging system 10 is used to generate and acquire data corresponding to the differential transmission of X-rays through the patient or imaged object. Though the imaging systems 10 discussed herein may be generally described in the context of medical imaging, it should be understood that such examples and context are merely provided to facilitate explanation and understanding and that the asymmetric cathode discussed herein may be equally useful in industrial and security imaging contexts, such as for non-destructively inspecting manufactured part, passengers, baggage, packages, and so forth.

In the embodiment illustrated in FIG. 1, the imaging system 10 includes an X-ray source 12. As discussed in detail herein, the source 12 may include one or more conventional X-ray sources, such as an X-ray tube. For example, the source 12 may include an X-ray tube with an asymmetric cathode assembly 14 (discussed in greater detail below) and an anode 16. The asymmetric cathode assembly 14 may accelerate a stream of electrons 18 (i.e., the electron beam), some of which may impact the target anode 16. The electron beam 18 impacting on the anode 16 causes the emission of an X-ray beam 20.

The source 12 may be positioned proximate to a beam limiter or shaper 22 (e.g., a collimator). The beam limiter or shaper 22 typically defines the size and shape of the one or more X-ray beams 20 that pass into a region in which a subject 24 or object is positioned. Each X-ray beam 20 may be generally fan-shaped or cone-shaped, depending on the configuration of the detector array and/or the desired method of data acquisition. An attenuated portion 26 of each X-ray beam 20 passes through the subject or object, and impacts a detector array, represented generally at reference numeral 28.

The detector 28 is generally formed by a plurality of detector elements that detect the X-ray beams 20 after they pass through or around a subject or object placed in the field of view of the imaging system 10. Each detector element produces an electrical signal that represents the intensity of the X-ray beam incident at the position of the detector element when the beam strikes the detector 28. Electrical signals are acquired and processed to generate one or more scan datasets.

In the depicted example, a system controller 30 commands operation of the imaging system 10 to execute examination and/or calibration protocols and to process the acquired data. The source 12 is typically controlled by a system controller 30. Generally, the system controller 30 furnishes power, focal spot location, control signals and so forth, for the X-ray examination sequences. The detector 28 is coupled to the system controller 30, which commands acquisition of the signals generated by the detector 28. The system controller 30 may also execute various signal processing and filtration functions, such as initial adjustment of dynamic ranges, interleaving of digital image data, and so forth. In the present context, system controller 30 may also include signal processing circuitry and associated memory circuitry. As discussed in greater detail below, the associated memory circuitry may store programs, routines, and/or encoded algorithms executed by the system controller 30, configuration parameters, image data, and so forth. In one embodiment, the system controller 30 may be implemented as all or part of a processor-based system such as a general purpose or application-specific computer system.

In the illustrated embodiment of FIG. 1, the system controller 30 may control the movement of a linear positioning subsystem 32 and a rotational subsystem 34 via a motor controller 36. In an embodiment where the imaging system 10 includes rotation of the source 12 and/or the detector 28, the rotational subsystem 34 may rotate the source 12, the beam shaper 22, and/or the detector 28 relative to the subject 24. It should be noted that the rotational subsystem 34 might include a C-arm or rotating gantry. In systems 10 in which images are not acquired at different angles relative to the patient or object 24, the rotational subsystem 34 may be absent.

The linear positioning subsystem 32 may linearly displace a table or support on which the subject or object being imaged is positioned. Thus, the table or support may be linearly moved with respect to an imaging volume (e.g., the volume located between the source 12 and the detector 28) and enable the acquisition of data from particular areas of the subject or object and, thus the generation of images associated with those particular areas. Additionally, the linear positioning subsystem 32 may displace one or more components of the beam shaper 22, so as to adjust the shape and/or direction of the X-ray beam 20. Further, in embodiments in which the source 12 and the detector 28 are configured to provide extended or sufficient coverage along the z-axis (i.e., the axis generally associated with the length of the patient table or support and/or with the lengthwise direction of an imaging bore) and/or in which the linear motion of the subject or object is not required, the linear positioning subsystem 32 may be absent.

The source 12 may be controlled by an X-ray controller 38 disposed within the system controller 30. The X-ray controller 38 may be configured to provide power and timing signals to the source 12. In addition, in some embodiments the X-ray controller 30 may be configured to specify focal spot location and/or size and, in certain implementations discussed herein, which filament element of an asymmetric cathode is in use during a given procedure.

The system controller 30 may also comprise a data acquisition system (DAS) 40. In one embodiment, the detector 28 is coupled to the system controller 30, and more particularly to the data acquisition system 40. The data acquisition system 40 receives data collected by readout electronics of the detector 28. The data acquisition system 40 typically receives sampled analog signals from the detector 28 and converts the data to digital signals for subsequent processing by a processor-based system, such as a computer 42. Alternatively, in other embodiments, the detector 28 may convert the sampled analog signals to digital signals prior to transmission to the data acquisition system 40.

In the depicted embodiment, a computer 42 is coupled to the system controller 30. The data collected by the data acquisition system 40 may be transmitted to the computer 42 for subsequent processing. For example, the data collected from the detector 28 may undergo pre-processing and calibration at the data acquisition system 40 and/or the computer 42 to produce useful imaging data of the subject or object undergoing imaging. In one embodiment, the computer 42 contains data processing circuitry 44 for filtering and processing the data collected from the detector 28.

The computer 42 may include or communicate with a memory 46 that can store data processed by the computer 42, data to be processed by the computer 42, or routines and/or algorithms to be executed by the computer 42. It should be understood that any type of computer accessible memory device capable of storing the desired amount or type of data and/or code may be utilized by the imaging system 10. Moreover, the memory 46 may comprise one or more memory devices, such as magnetic, solid state, or optical devices, of similar or different types, which may be local and/or remote to the system 10.

The computer 42 may also be adapted to control features enabled by the system controller 30 (i.e., scanning operations and data acquisition). Furthermore, the computer 42 may be configured to receive commands and scanning parameters from an operator via an operator workstation 48 which may be equipped with a keyboard and/or other input devices. An operator may, thereby, control the system 10 via the operator workstation 48. Thus, the operator may observe from the computer 42 a reconstructed image and/or other data relevant to the system 10. Likewise, the operator may initiate imaging or calibration routines, select and apply image filters, and so forth, via the operator workstation 48.

As illustrated, the system 10 may also include a display 50 coupled to the operator workstation 48. Additionally, the system 10 may include a printer 52 coupled to the operator workstation 48 and configured to print images generated by the system 10. The display 50 and the printer 52 may also be connected to the computer 42 directly or via the operator workstation 48. Further, the operator workstation 48 may include or be coupled to a picture archiving and communications system (PACS) 54. It should be noted that PACS 54 might be coupled to a remote system 56, radiology department information system (RIS), hospital information system (HIS) or to an internal or external network, so that others at different locations can gain access to the image data.

Figure 2:
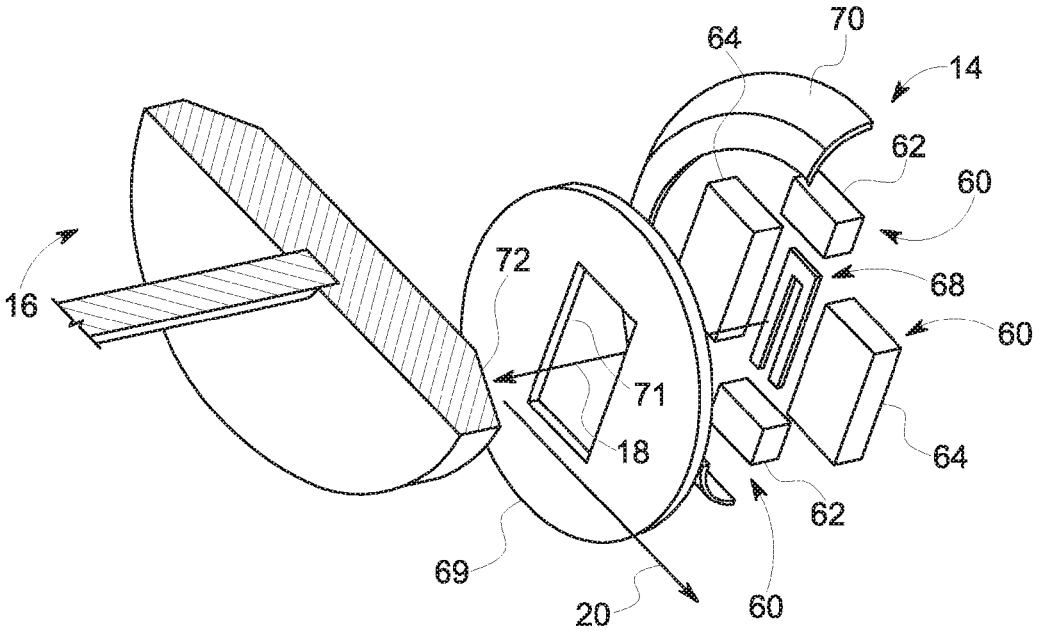
FIG. 2 illustrates and embodiment of an X-ray tube assembly, including an anode and a cathode assembly, in accordance with an embodiment of the present disclosure.

With the foregoing general system description in mind and turning now to FIG. 2, this figure schematically depicts aspects of an embodiment of an X-ray tube assembly, including embodiments of the asymmetric cathode assembly 14 and the anode 16. In the illustrated embodiment, the asymmetric cathode assembly 14 and the target anode 16 are oriented towards each other. The anode 16 may be manufactured of any suitable metal or composite, including tungsten, molybdenum, or copper. The anode's surface material is typically selected to have a relatively high refractory value so as to withstand the heat generated by electrons impacting the anode 16. In certain embodiments, the anode 16 may be a rotating disk, as illustrated, though in other implementations the anode may be stationary during use. In rotating anode implementations the anode 16 may be rotated at a high speed (e.g., 1,000 to 10,000 revolutions per minute) so as to spread the incident thermal energy and achieve a higher temperature tolerance. The rotation of the anode 16 results in the temperature of the X-ray focal spot 72 (i.e., the location on the anode impinged upon by the electrons) being kept at a lower value than when the anode 16 is not rotated, thus allowing for the use of high flux X-rays embodiments.

The electron beam 18 generated by the cathode assembly 14 is focused on the X-ray focal spot 72 on the anode 16. The space between the cathode assembly 14 and the anode 16 is typically evacuated in order to minimize electron collisions with other atoms and to maximize an electric potential. A strong electric potential, in some cases as high as 140 kV during use and as high as 175 kV during seasoning and other preparation protocols associated with medical imaging, is typically created between the cathode 14 and the anode 16, causing electrons emitted by the cathode 14 through the thermionic effect to become strongly attracted to the anode 16. The resulting electron beam 18 is directed toward the anode 16. The resulting electron bombardment of the focal spot 72 generates an X-ray beam 20 through the Bremsstrahlung effect, i.e., braking radiation.

The depicted cathode assembly 14 includes a set of bias electrodes 60 (i.e., deflection electrodes). In the depicted example, the four bias electrodes include length bias electrodes 62 (i.e., a length inside (L-ib) bias electrode and length outside (L-ob) bias electrode) and width bias electrodes 64 (i.e., a width left (W-l) bias electrode and a width right (W-r) bias electrode), that together may be used as an electron focusing lens. In accordance with implementations discussed herein, the bias electrodes 60 are of different effective lengths but have the same width (i.e., a common width) and are used with a narrow range of focusing voltages (e.g., −4 kV to +4 kV) on the electrodes to generate complaint focal spots on the anode 16. A shield 70 may be positioned to surround the bias electrodes 60 and connected to cathode potential. The shield 70 may aid in, for example, reducing peak electric fields due to sharp features of the electrode geometry and thus improve high voltage stability. In addition, a highly polished shield 70 reduces the thermal load or total absorbed thermal power absorbed by the cathode 14.

In certain embodiments, an extraction electrode 69 is included and is disposed between the cathode assembly 14 and the anode 16. In other embodiments, the extraction electrode 69 is not included. When included, the extraction electrode may be kept at a potential as high as 20 kV more positive than cathode 14. The opening 71 allows for the passage of electrons through the extraction electrode 69.

As mentioned above, the temperature of the flat filaments 68 is regulated so that electrons are emitted from the filament 68 when in use (e.g., when heated above an electron emitting temperature). The majority of the electrons are emitted in a direction normal to the planar area defined by the filament 68. Thus, the resulting electron beam 18 is surrounded by the bias electrodes 60. The bias electrodes 60 aid in focusing the electron beam 18 into a focal spot 72 on the anode 16 through the use of active beam manipulation. That is, the bias electrodes 60 may each create a dipole field so as to electrically deflect the electron beam 18. The deflection of the electron beam 18 may then be used to aid in the focal spot targeting of the electron beam 18. Width bias electrodes 64 may be used to help define the width of the resulting focal spot 72, while length bias electrodes 62 may be used to help define the length of the resulting focal spot 72. In accordance with present implementations, the focusing voltages associated with the bias electrodes 60 are in the range of −4 kV to +4 kV to generate a complaint focal spot on the target (i.e., anode).

The preceding figures and discussion relate at a general, schematic level, certain aspects of the cathode assembly and an imaging system that may employ such a cathode assembly for X-ray generation. Certain structural aspects of an asymmetric flat emitter for use in the cathode assembly will now be introduced and discussed. As discussed herein, in the depicted examples asymmetric cathodes are described that are multi-filament cathodes in which different flat filaments have different effective lengths when deployed. In the present examples, the flat filaments are simple flat filaments, each having one temperature zone and the same or comparable width, though these factors may be varied in other implementations. The resulting cathode, in one embodiment, has a bias voltage precision or tolerance to error of ±2.0% or better, ≤−8 kV grid voltage, a width bias range of 0.3 kV to +2 kV and a length bias range of ±4 kV max. In other embodiments these values may vary based on the desired system configuration.

Though the present examples generally are described as having two filaments (i.e., a shorter and a longer filament), it should be appreciated that in other embodiments, more than two filaments of different effective lengths may be present in the cathode assembly. Further, though the filaments described herein are effectively different in length, they operationally overlap in terms of the focal spots sizes they support, allowing some degree of redundancy in supported focal spot sizes for the filaments, and thereby effectively increasing the lifespan of the cathode assembly.

With this in mind, in a present implementation an asymmetric flat emitter cathode design allows two different emitters (i.e., flat filaments) to generate a small focal spot (e.g., 0.6 IEC) at high current without early life failure, such as due to evaporation of the emissive material. That is, the long emitter filament can be focused (such as by the bias electrodes) to provide a small focal spot. Similarly, the small emitter filament can also be focused to provide a small focal spot as well. That is, both emitter filaments can be used to generate different, but overlapping (e.g., at 0.5 IEC to 0.6 IEC) ranges of focal spot size such that both emitter filaments can share the small spot 'fluoro' duty, and so share the life of the X-ray tube, effectively extending the life of the cathode assembly. In accordance with this approach, workload over the shared or overlapping focal spot size range may be shared or split between the two differently sized filaments and/or in the event of failure of one filament, the remaining filament may still be used to generate focal spots within the overlapping focal spot size range.

Figure 3:
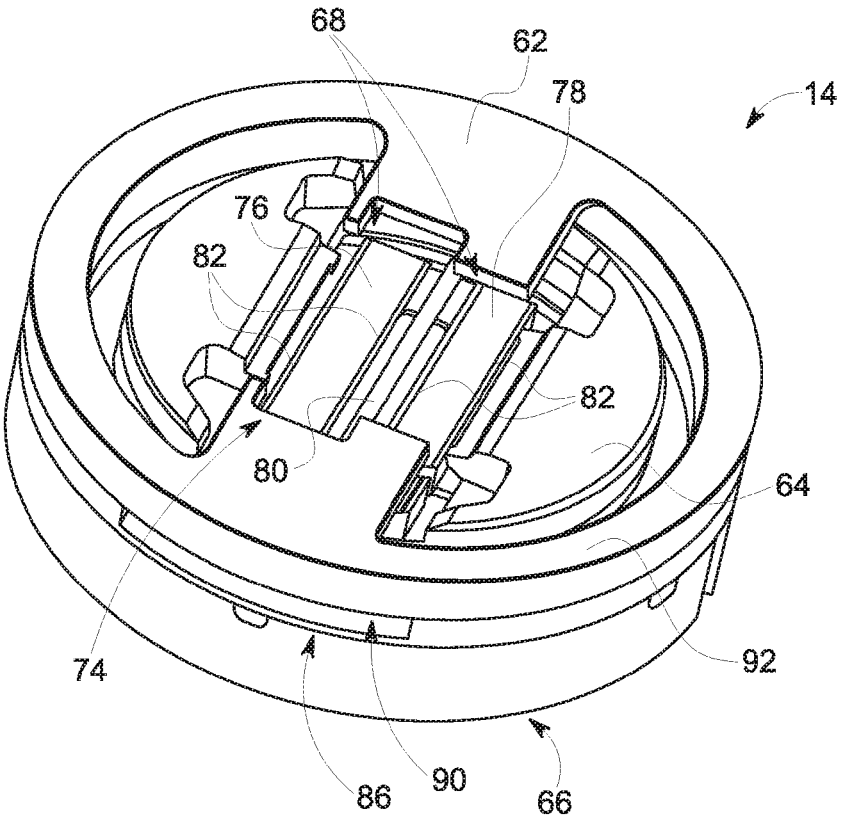
FIG. 3 depicts an asymmetric cathode assembly, in accordance with an embodiment of the present disclosure.

Turning to FIG. 3, as example of an asymmetric cathode assembly 14 is provided. In this example, the cathode assembly 14 includes length bias electrodes 62 (provided as a single piece stackable ring structure) and width bias electrodes 64 (provided as a single piece stackable ring structure). The length and width bias electrodes define a region through which two electron emissive flat filaments 68 (e.g., flat tungsten emitters) are visible. In the depicted example, the stackable structures corresponding to the length bias electrodes and width bias electrodes are stacked or positioned on a ceramic insulator or substrate 66 to form the cathode assembly 14.

A septum 80 separates the emissive flat filaments 68 and is itself a width bias electrode (i.e., it operates to define the width of the resulting focal spot 72) operating at the same potential as the primary width bias electrode 64. In one embodiment the septum 80 has a vertical, pyramidal cross-section that differs from the flat shape of the width electrodes 64 suspended over the plane of the emitter filaments 68 in the context of the cathode assembly 14. With respect to the bias electrodes 60 (e.g., width bias electrodes 64) and the septum 80, the focusing effect of lower voltages (e.g., ±4 kV versus a higher range of voltages) is more pronounced and, correspondingly, more efficient. There is no electron beam current on the septum 80 at the highest positive (+) voltage, which prevents overload of the electrode power supply (keeping power supply dimensions and designed capacity small) and malfunction.

In one embodiment, one or both of the length electrodes 62 and/or width electrodes 64 are thin electrodes (e.g., 1 mm-2 mm thick) In the depicted example, and as shown in subsequent illustrations, The length electrodes 62 are anchored to or continuous with a ring structure 92 surrounding the width electrodes 64 and emitter filaments 68. This geometry permits electric fields generated by the voltage difference during operation (i.e., −V at the emitter filament 68 and +V at the target (i.e., anode 16) to reach the emitter surfaces. Electrons are thus more easily extracted from emitter surfaces and accelerated toward the target. In one embodiment, the bias electrodes 60 (i.e., length electrodes 62 and width electrodes 64) are positioned close to the emitter filaments 68 to facilitate electron extraction and acceleration and thus achieve the high beam currents necessary for imaging operations (e.g., 400 mA-1200 mA for small spots (e.g., 0.6 IEC) in a fluoroscopy mode.

In certain embodiments, the emitter filaments 68 may each be flanked by a thin, grounded metal feature 82 (referred to herein as a "cold track") that is elevated or protrudes relative to the emitter filament surfaces (e.g., a bump). In certain implementations, the cold tracks are fabricated from nickel, molybdenum, molybdenum alloys, and so forth. The cold tracks 82 help shape the electric fields and, thereby improve the focus of the electron beam extracted from the emitter filaments 68. In particular, electrical potentials placed on the width bias electrodes 64 which may be less than or about 1 mm distant, create fields strong enough to extract current that cannot be focused. The cold tracks 82 are at the same potential as the emitter filaments 68. The narrow metal cold tracks 82 act to shield the width bias electrodes, thereby eliminating unusable extracted current and helping to focus the electron beam. In this manner, the cold tracks prevent electrons from being directed to or impacting, and potentially melting, the width bias electrodes 64. In addition, the cold tracks prevent extracted electron beam current from adversely affecting width bias voltage power supplies.

As shown in FIG. 3, the length electrodes 62 have a geometry that includes a notch region 74 with respect to one filament such that a greater length or area of the respective filament is exposed for electron emission. Hence, this more exposed filament is referred to herein as the long or longer filament (or emitter) 76. Conversely, the filament that has less area exposed is referred to herein as the short or shorter filament (or emitter) 78. The two different lengths of emissive surfaces of the emitter filaments can be used to produce different ranges of focal spot sizes at the same location on the target (i.e., anode 16) using the same cathode structure (i.e., cathode assembly 14). By way of example, in one implementation the long emitter filament 76 produces large focal spot sizes (e.g., IEC 1.0) and small focal spots sizes (e.g., IEC 0.6) while the short emitter filament 78 produces small focal spot sizes (e.g., IEC 0.6) and concentrated focal spots sizes (e.g., IEC 0.3).

Figure 4:
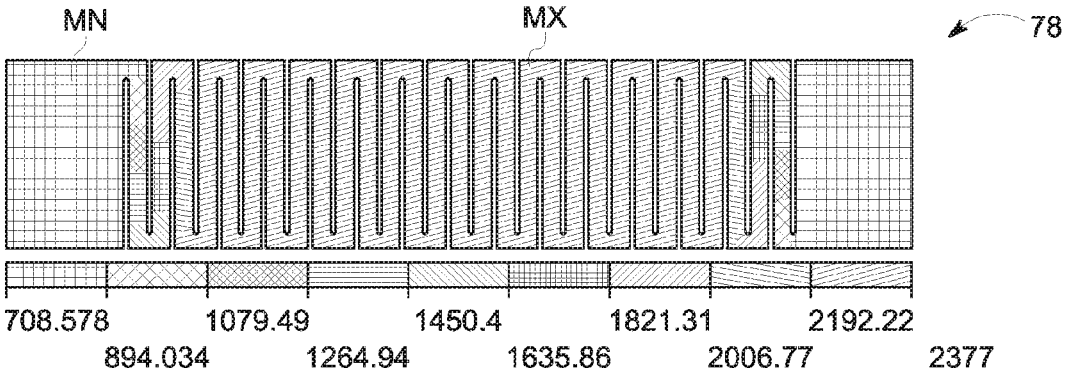
FIG. 4 depicts an implementation of a short emitter filament, in accordance with an embodiment of the present disclosure.
Figure 5:
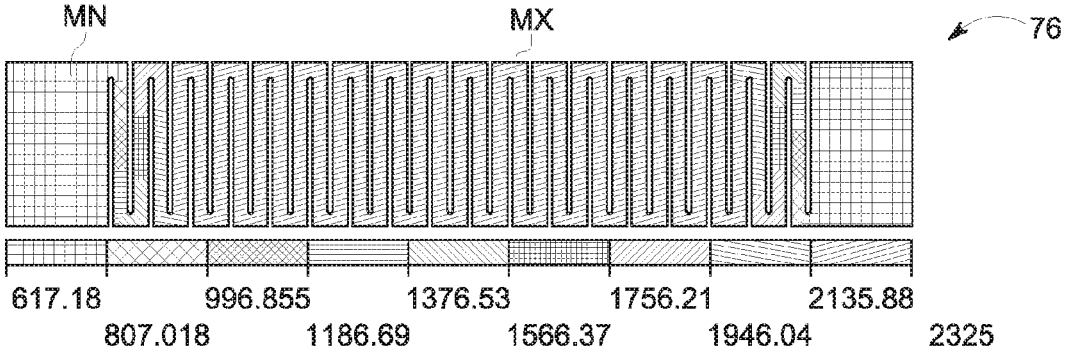
FIG. 5 depicts an implementation of a long emitter filament, in accordance with an embodiment of the present disclosure.

By way of example, FIGS. 4 and 5 respectively depict an example of a short emitter filament 78 and a long emitter filament 76. In one implementation, the emitter filaments are approximately 200μ thick. In one example the shorter emitter filament 78 has an emissive surface (i.e., a surface that is heated to an electron emitting temperature) that is 3.2 mm×6.5 mm while the longer emitter filament has an emissive surface that is 3.2 mm×11 mm. In the depicted example, the emissive material forming the emitter filaments (either an emissive coating or substrate metal) is formed or otherwise provided in a meander or serpentine geometry. In addition, the depicted examples of FIGS. 4 and 5 also convey operational temperature range information. In particular, in the depicted example, the shorter emitter filament, operating at 400 mA, reaches a temperature of 2,377° C. while the longer emitter filament, operating at 400 mA, reaches an operational temperature of 2,320° C.

Figure 6:
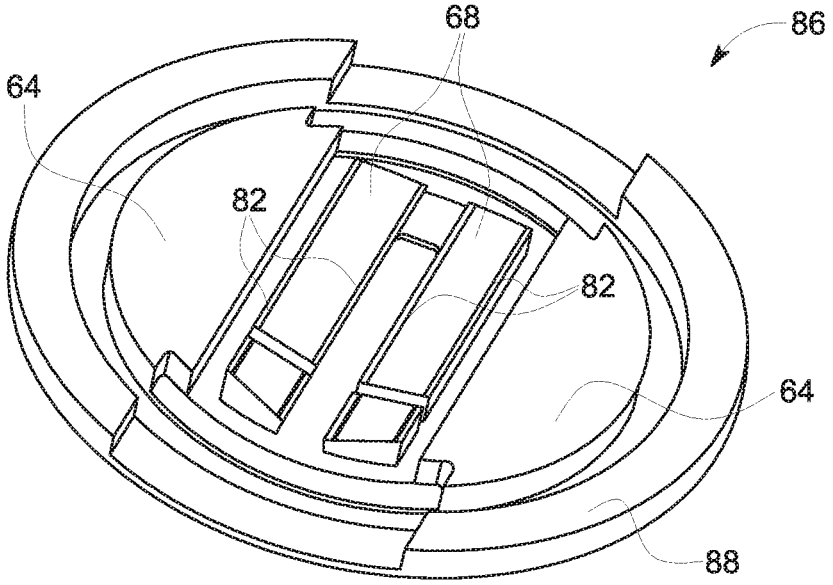
FIG. 6 depicts a width bias electrode layer for use in a cathode assembly, in accordance with an embodiment of the present disclosure.
Figure 7:
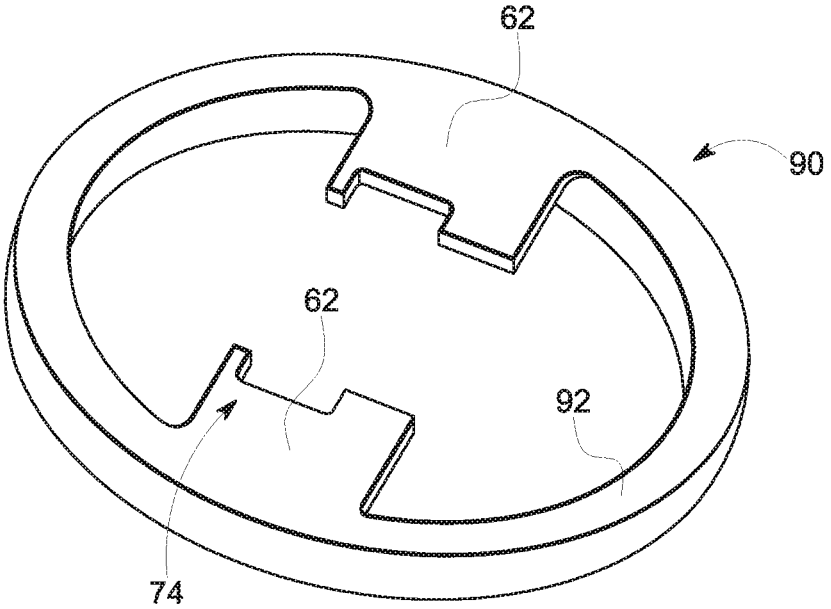
FIG. 7 depicts a length bias electrode layer for use in a cathode assembly, in accordance with an embodiment of the present disclosure.

FIGS. 6 and 7 depict, respectively, the layer 86 of the cathode assembly 14 corresponding to the width bias electrodes 64, along with the surrounding support ring 88 (FIG. 6) and the layer 90 of the cathode assembly 14 corresponding to the length bias electrodes 62, along with the surrounding support ring 92 (FIG. 7). As shown in FIGS. 3, 6, and 7 in the depicted example, the width electrode is undercut and the width electrode material is removed near the length electrodes. Both width electrode layer 86 and length electrode layer 90 may, in one implementation, be fabricated mechanically as brazed metal parts, with portions cut away to provide the depicted geometry during fabrication. The resulting layers 86, 90 can then be stacked to form aspects of the cathode assembly 14 shown in FIG. 3. In addition, it may be noted that, as shown in FIG. 6, the emitter filaments 68 need not be co-planar (i.e., the emissive surfaces need not be in the same plane or parallel). Instead the emissive surfaces of the emitter filaments 68 may be angled relative to one another, such as angled toward a common focal spot point, as shown in FIG. 6.

Figure 8:
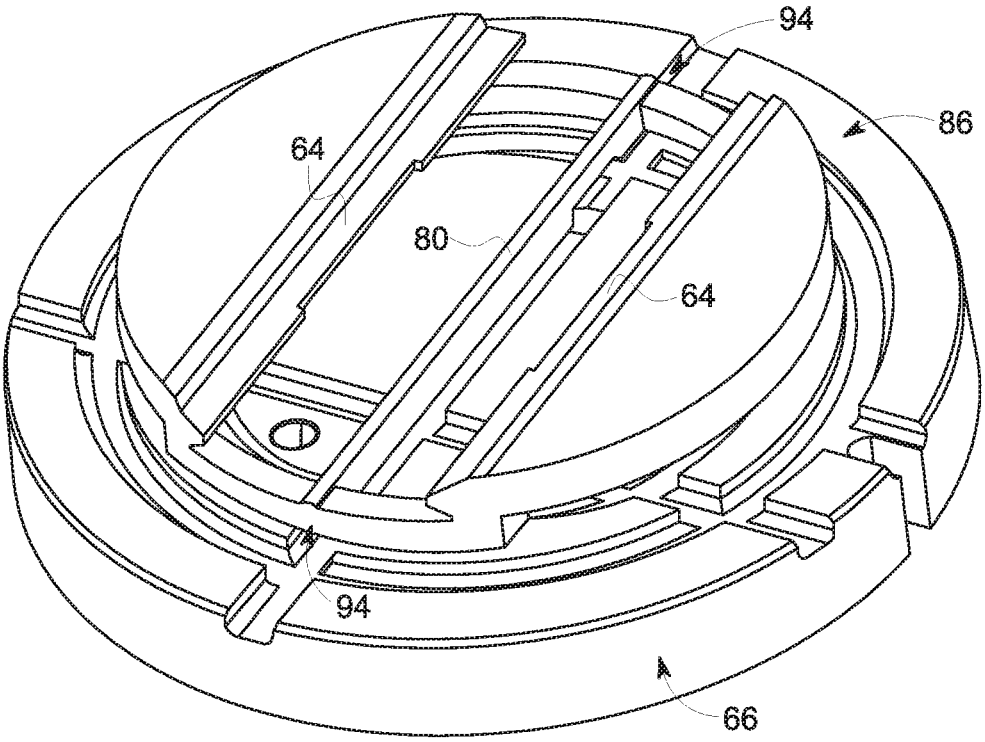
FIG. 8 depicts an implementation of a septum fixed on both ends, in accordance with an embodiment of the present disclosure.
Figure 9:
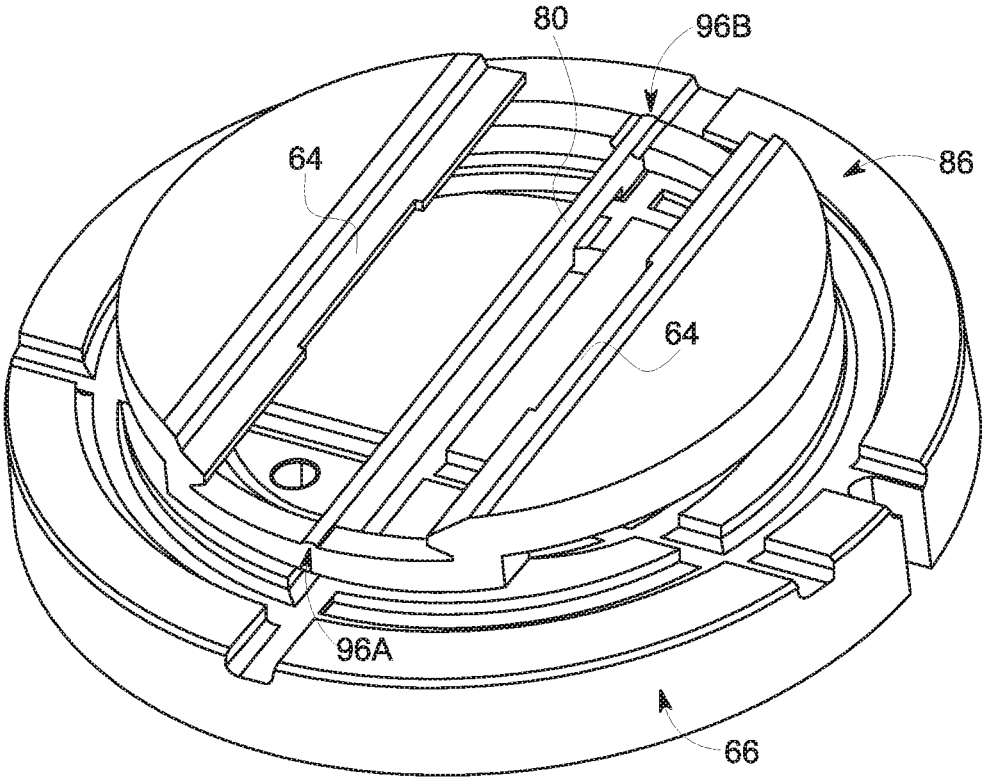
FIG. 9 depicts an implementation of a septum fixed on one end, in accordance with an embodiment of the present disclosure.

Turning to FIGS. 8 and 9, two different embodiments of the width electrode layer 86 are illustrated in conjunction with the septum 80, which may be formed as part of the layer 86 or formed separately and attached to the layer 86 after fabrication (i.e., as a drop-in component). In FIG. 8, the septum 80 is shown as being integral with or attached at both ends 94 so as to be relatively immobile relative to the filaments 68 and bias electrodes (e.g., width electrodes 64). In such an implementation, the septum 80 is fixed at both end as an integral part of the width electrode layer 86 or cap.

In contrast, in FIG. 9, the septum 80 is fixed at only one end 94 and is not fixed at the opposite end 96. In such an implementation, the septum 80 may be fabricated separately and "dropped-in" to slots 96A, 96B in the Kovar cup. The septum 80 may then be affixed or otherwise attached (e.g., laser welded) at one end (here, slot 96A) while left unaffixed at the other end (here, slot 96B). As a result, in the embodiment shown in FIG. 9, the septum 80, at one end 96, is free to move to a limited extent (e.g., tens of microns) in two- or three-dimensions.

Figure 10:
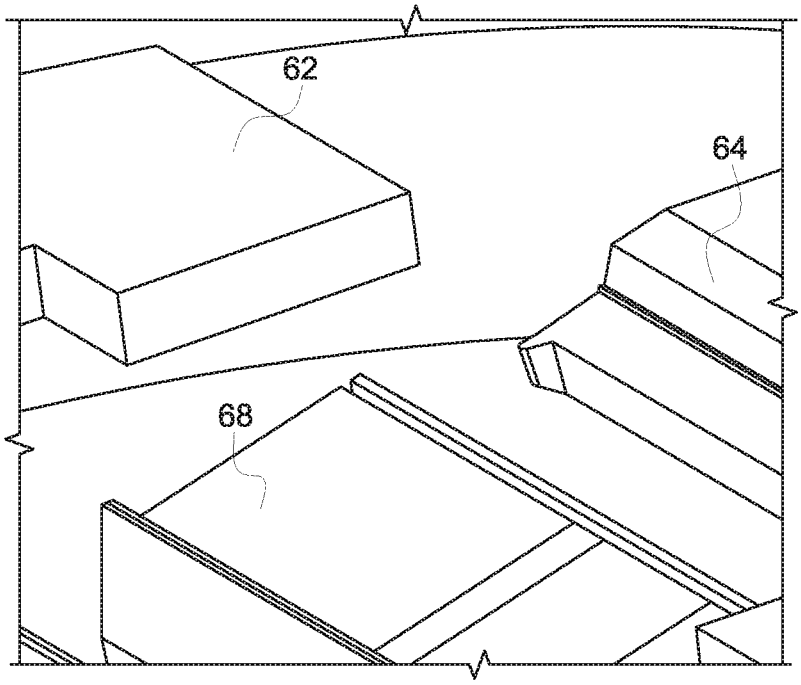
FIG. 10 depicts geometry and spacing dimensions of a length bias electrode and width bias electrode, in accordance with an embodiment of the present disclosure.
Figure 11:
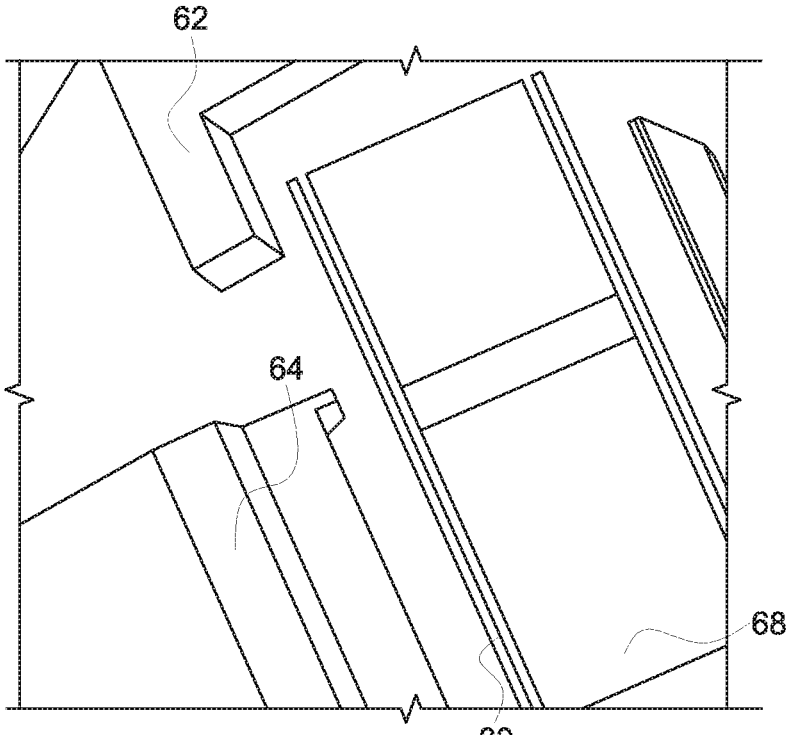
FIG. 11 depicts geometry and spacing dimensions of a cold track and width bias electrode, in accordance with an embodiment of the present disclosure.

Turning to FIGS. 10 and 11, perspective views of the spatial arrangement of certain features described herein are provided so as to provide both geometric context of these features and to illustrate certain suitable spacing distances. For example, in FIG. 10, a view of a length bias electrode 62 relative to a width bias electrode 64 is shown along with the nearest spacing between the two, here approximately 2 mm (e.g., 1.9264 mm). Similarly, FIG. 11 depicts the geometry of a width bias electrode 64 and cold track 80 and the corresponding nearest spacing, here approximately 1 cm (e.g., 1.0935 mm).

Figure 12:
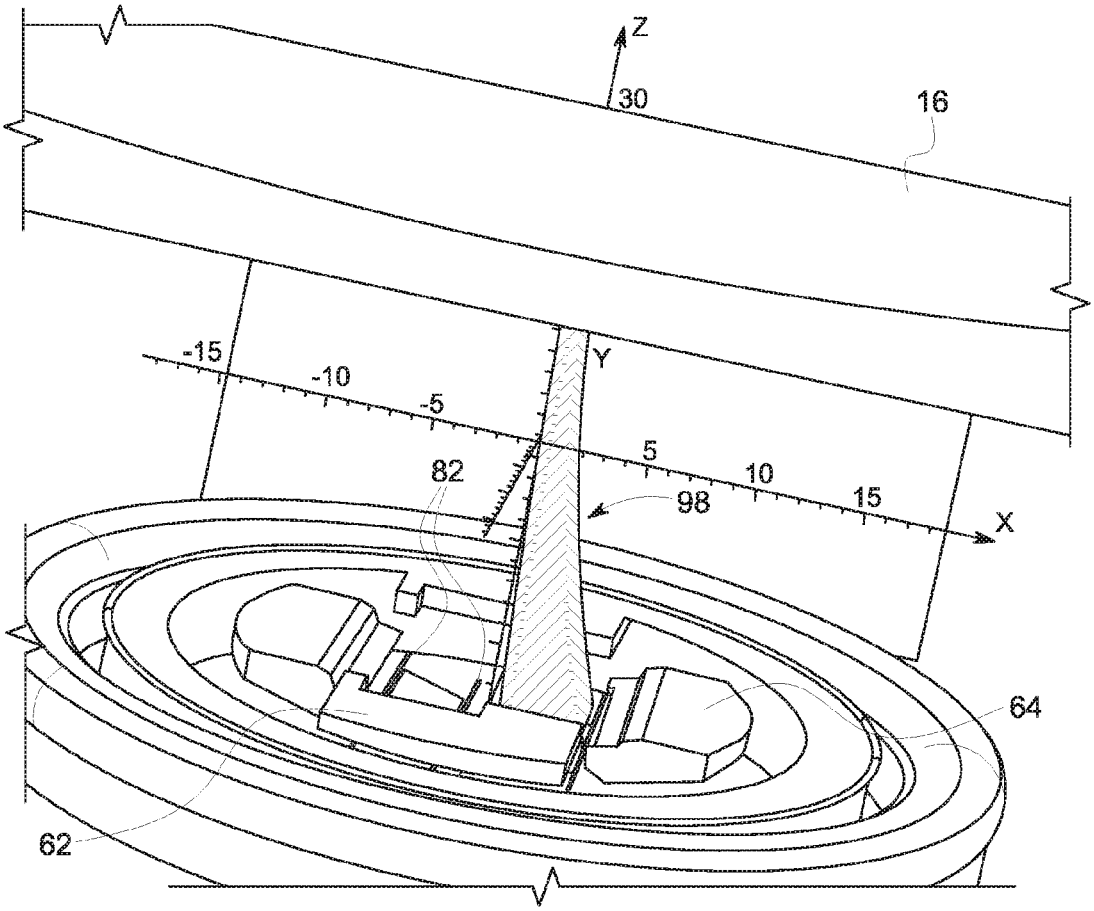
FIG. 12 depicts an operational illustration of an electron beam generated by an asymmetric cathode, in accordance with an embodiment of the present disclosure.

Turning to FIG. 12, an operational view of an asymmetric cathode assembly 14 as discussed herein is shown. In this example, an electron beam 98 is shown emitted by the short emitter filament 78 to impact the target 16. Focusing of the electron beam 98 is accomplished using the voltages applied to the length bias electrodes 62, width bias electrodes 64, and septum 80, with the cold tracks 82 also helping to focus the electron beam 98 by eliminating unusable extracted current.

Figure 13:
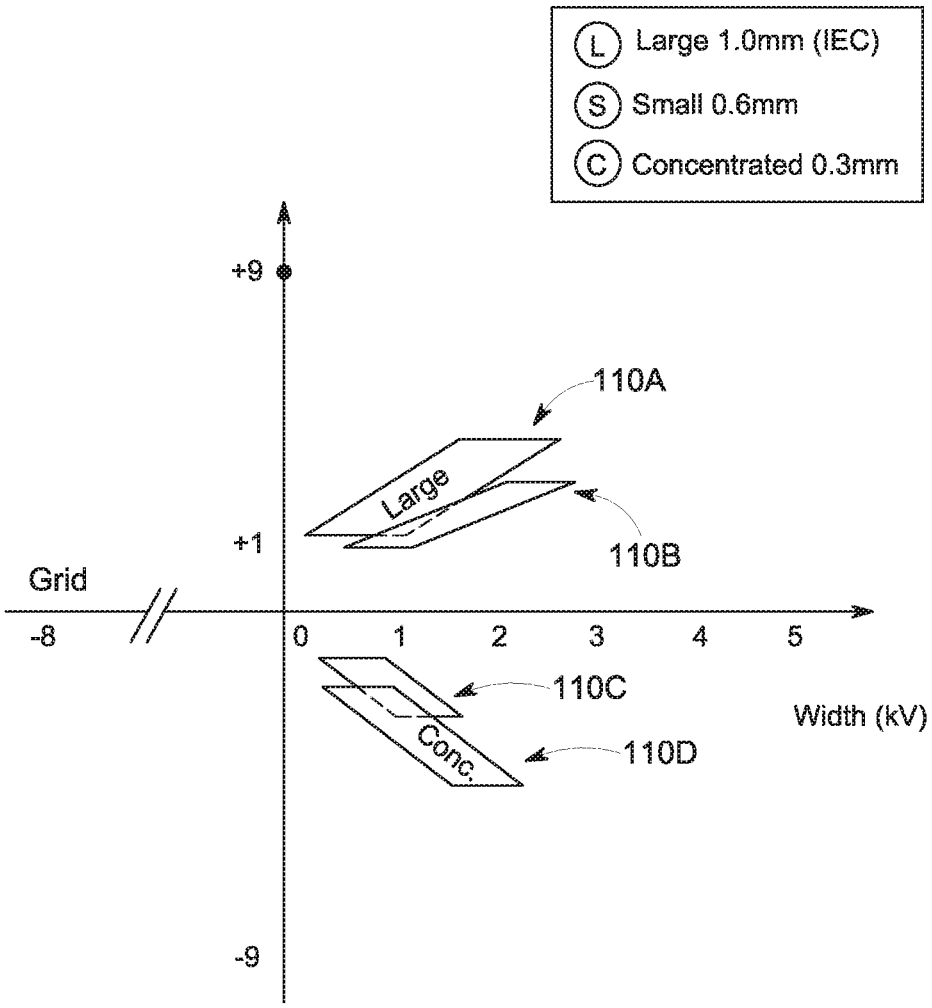
FIG. 13 graphically illustrates focal spot size overlap for different electrodes of an asymmetric cathode, in accordance with an embodiment of the present disclosure.

With the preceding in mind regarding structural and operational aspects of an asymmetric cathode as discussed herein, FIG. 13 depicts a graphical representation of how focal spots (concentrated (0.3 IEC), small (0.6 IEC), and large (1.0 IEC)) are created using either a short emitter filament 78 or a long emitter filament 76 as discussed herein. In the depicted example, delineated zones 110 depict the ranges of electrode voltages corresponding to what would be employed to generate the reference spot size, with zone 110A corresponding to a large spot size using the long emitter filament 76, zone 110B corresponding to a small spot size using the long emitter filament 76, zone 110C corresponding to a small spot size using the short emitter filament 78, and zone 110D corresponding to a concentrated spot size using the short emitter filament 78. In the depicted example, the grid voltage (suitable for fluoroscopy mode operation) is below the ±10 kV limit and bias voltages (for correct focal spot size) are below the high voltage generator limits. Only 2% voltage regulation is required for suitable focal spot size control, with nominal regulation on the order 0.5%.

As illustrated in FIG. 13, small focal spot sizes (e.g., a focal spot size suitable for fluoroscopy) can be made by using the short emitter filament 78 as well as the long emitter filament 76. Thus the workload for generating such small focal spots may be spread between both filaments to extend the lifetime of the cathode assembly or small focal spot sizes may continue to be generated after one filament fails by using the remaining filament.

In view of the preceding, emitter life calculations have been made using detailed simulations and/or models. Results are shown in Table 1. As may be observed, X-ray tube life may be improved (e.g., nearly three times baseline case) by sharing fluoroscopy mode imaging workload between the short emitter filament 78 and long emitter filament 76.

TABLE 1

| Emitter Filament(s) (short (S) or long (L))\|Current | | | Imaging Mode |
|---|---|---|---|
| S\|400 mA | L\|400 mA | L & S | Fluoroscopy |
| L\|900 mA | L\|900 mA | L\|900 mA | Record |
| S\|400 mA | S\|400 mA | S\|400 mA | Compressed |
| 500 | 1,100 | 1,450 | Total Hours |
| 100% | 220% | 290% | Life Ratio |

As shown in Table 1, the imaging mode (fluoroscopy, record, or compressed) is indicated in the rightmost column for three rows of the table. In these three rows, the leftmost columns indicate which emitter filaments are used for each mode (the long emitter filament (L), the short emitter filament (S), or both (L & S). The fifth row indicates the modeled X-ray tube lifetime in total hours and, based on a baseline case corresponding to the leftmost scenario, life ratios are calculated and shown in the bottommost row. Based on these results, shared usage of the long and short emitter filaments in a fluoroscopy imaging mode using an asymmetric cathode is expected to maximize X-ray tube life.

Technical effects of the invention include a cathode assembly, such as for us in an X-ray tube, that has two differently sized electron emitter filaments. In operation, workload for certain operations may be spread between the differently sized filaments, such as over an overlapping operational range of the differently sized filaments, to extend the useful life of the emitter filaments. By way of example, a long and short emitter filament may both be used to generate a small focal spot (0.6 IEC) suitable for fluoroscopy in an X-ray imaging context. In one such example, both the long and short emitter filaments can function in gridded mode, thus enabling fluoroscopy mode operation from either emitter. Further, the partial redundancy allows the end user to switch emitters should one emitter fail during a procedure and continued operation is necessary for safe procedure end (withdrawal of catheters, and so forth).

In this example, the short emitter filament is also suitable for producing concentrated (0.3 IEC) focal spots since the length is only 6.5 mm (in this embodiment) and therefore requires only modest length-wise focusing voltages ±4 kV. The long emitter filament is also suitable for producing large focal spots (1.0 IEC) and has a large area for large beam current extraction and modest temperature, therefore extending emitter life.

For described embodiments, length bias voltages are below 4 kV. Lower voltages are easier to produce in the HV generator and produce less stress the on solid dielectric portion of the cathode cup. Commercial advantages include, but are not limited to: longer emitter life, less frequent replacement, and fewer field engineer service calls.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A cathode assembly, comprising:

at least two flat filaments each comprising an electron emissive surface when heated, wherein a first flat filament has an electron emissive area that is less than an electron emissive area of a second flat filament;

a set of width bias electrodes positioned along a first dimension of the flat filaments, wherein the set of width bias electrodes controls the width of a focal spot generated by the flat filaments during operation;

a set of length bias electrodes positioned along a second dimension of the flat filaments, wherein the set of length bias electrodes controls the length of the focal spot during operation; and a septum positioned between the first flat filament and the second flat filament, wherein the septum is at the same potential as the width bias electrodes during operation.

2. The cathode assembly of claim 1, wherein the first flat filament and the second flat filament have the same width and thickness but differ in an effective length of the respective electron emissive surfaces.

3. The cathode assembly of claim 2, wherein the first flat filament has a length less than the second flat filament.

4. The cathode assembly of claim 1, wherein the length bias electrodes comprise a notch region proximate to the second flat filament so that a greater emissive region of the second flat filament is exposed.

5. The cathode assembly of claim 1, wherein the septum is fixed at one or both ends of the septum to a width electrode support ring.

6. The cathode assembly of claim 1, further comprising a pair of grounded metal features disposed adjacent the electron emissive surface on each flat filament and running parallel to the width electrodes, wherein the pair of grounded metal features on each flat filament protrude or are elevated relative to the electron emissive surface of the respective flat filament.

7. The cathode assembly of claim 6, wherein the pairs of grounded metal features are at the same potential as the flat filaments during operation.

8. The cathode assembly of claim 1, wherein the at least two flat filaments are angled relative to one another such that the respective electron emissive surfaces of each filament are generally perpendicular to a focal spot location during operation.

9. The cathode assembly of claim 1, wherein the first flat filament is sized to generate focal spots on a target within a first size range and the second flat filament is sized to generate focal spots on the target in a second size range that partially overlaps with the first size range.

10. An X-ray tube, comprising:

an anode; and a cathode, comprising:

a pair of flat filaments that emit electrons when heated, wherein a first flat filament is longer than a second flat filament of the pair of flat filaments;

a pair of width bias electrodes positioned on opposite sides of the pair of flat filaments along a first dimension;

a pair of length bias electrodes positioned on opposite sides of the pair of flat filaments along a second dimension perpendicular to the first dimension; and a septum positioned between the pair of flat filaments and running in the same direction as the pair of width bias electrodes, wherein the septum is at the same potential as the width bias electrodes during operation.

11. The X-ray tube of claim 10, further comprising, on each flat filament, a pair of grounded metal features disposed adjacent an electron emissive surface of each flat filament and running parallel to the width electrodes, wherein the pair of grounded metal features on each flat filament protrude or are elevated relative to the electron emissive surface of the respective flat filament.

12. The X-ray tube of claim 11, wherein the pairs of grounded metal features are at the same potential as the flat filaments during operation.

13. The X-ray tube of claim 10, wherein the first flat filament and the second flat filament are angled relative to one another such that electron emissive surfaces of each flat filament are directed toward a focal spot location on the anode during operation.

14. The X-ray tube of claim 10, wherein the first flat filament is sized to generate focal spots on the anode within a first size range and the second flat filament is sized to generate focal spots on the anode in a second size range that partially overlaps with the first size range.

15. A method for generating an electron beam focal spot on a target, comprising:

receiving an input specifying a size of the electron beam focal spot on the target; and selectively operating a first emitter filament or a second emitter filament of a cathode assembly to generate an electron beam focal spot of the size specified by the input on the target, wherein the first emitter filament and the second emitter filament differ in length, by:

selecting the first emitter filament when the input specifies a first focal spot size;

selecting the first emitter filament and the second emitter filament when the input specifies a second focal spot size; and selecting the second emitter filament when the input specified a third focal spot size wherein selecting the first emitter filament and the second emitter filament when the input specifies a second focal spot size comprises taking into account a failure of the first emitter filament or the second emitter filament so as to allow generation of the second focal spot size when one of the first emitter filament or the second emitter filament is inoperative.

* * * * *